United States Patent [19]

Mallory, Sr.

[11] Patent Number: 5,066,313

[45] Date of Patent: Nov. 19, 1991

[54] WIRE ELECTRODE REPLACEMENT FOR ELECTROSTATIC PRECIPITATORS

[75] Inventor: Timothy P. Mallory, Sr., Pace, Fla.

[73] Assignee: Southern Environmental, Inc., Pensacola, Fla.

[21] Appl. No.: 585,190

[22] Filed: Sep. 20, 1990

[51] Int. Cl.[5] ..... B03C 3/00

[52] U.S. Cl. ..... 55/2; 55/151; 55/152; 55/154; 55/147; 55/148

[58] Field of Search ..... 55/148, 150–152, 55/154, 147, 2

[56] References Cited

U.S. PATENT DOCUMENTS 3,774,372 11/1973 Heer et al. ..... 55/147

*Primary Examiner*—Bernard Nozick

*Attorney, Agent, or Firm*—Kelly O. Corley

[57] ABSTRACT

A pair of wire electrodes in an electrostatic precipitator is replaced by a single rigid discharge electrode. Shrouds on the upper end of the rigid discharge electrode cooperate with the original supporting and locating means on the upper high voltage frame to suspend the rigid discharge electrode midway between the vertical grounded electrodes. Suspending means on the lower end of the rigid discharge electrode provide for suspending the weights originally suspended from the bottoms of the wire electrodes from the rigid discharge electrode in their original positions.

9 Claims, 3 Drawing Sheets

WIRE ELECTRODE REPLACEMENT FOR ELECTROSTATIC PRECIPITATORS

The invention relates to the art of electrostatic precipitators, and more particularly to replacement of wire discharge electrodes therein with rigid discharge electrodes.

Certain known electrostatic precipitators comprise first and second parallel vertical substantially planar grounded electrodes, each of the grounded electrodes having a plurality of vertical conductive stiffeners evenly spaced along the width thereof, corresponding stiffeners on the first and second grounded electrodes being opposed whereby an adjacent pair of stiffeners on the first grounded electrode together with a corresponding adjacent pair of stiffeners on the second grounded electrode define a discharge space partially separated from adjacent discharge spaces by the stiffeners. The precipitator further comprises an upper high voltage frame located above the plurality of discharge spaces and extending parallel to the planes of the grounded electrodes. The upper high voltage frame has a pair of spaced mounting means above each discharge space for supporting and aligning a corresponding pair of wire discharge electrodes, each mounting means comprising an upwardly facing supporting and alignment surface. A line connecting the centers of the pair of mounting means is parallel to and equally spaced from the planes of the first and second grounded electrodes, the line having a given length. Each wire discharge electrode has shroud means on an upper end thereof cooperating with the corresponding supporting and alignment surface whereby each wire electrode is located in an original position, and each wire discharge electrode and a lower end comprising suspending means for suspending an original weight individual to the wire discharge electrode in an original weight position. The precipitator further comprises restraining means for restricting movement of the original weights in the horizontal plane from the original weight positions. Such original weights typically weighed about 16 pounds each.

The wire electrodes in such precipitators have a relatively short service life, after which they must be replaced. This ordinarily means that the factory or plant whose exhaust stream is being cleaned by the precipitator must be shut down during the period required to replace the electrodes. The cost is accordingly not merely the direct expense of the overhaul, but also the lost production of the plant. In many instances, this lost production is a very substantial amount.

Later precipitators use a single rigid discharge electrode in each discharge space, the upper end of the rigid discharge electrode being mounted on the upper high voltage frame at a single point above and centered over the discharge space. Certain of the early precipitators of this type attached a single weight, typically about 30 pounds, to the lower end of the rigid discharge electrode, although the usual later practice was to mount the lower end on a single point centered below the discharge space on a lower high voltage frame. The rigid discharge electrodes have service lives considerably longer than typical wire discharge electrodes, two or three times as long being commonly observed. Such later precipitators are disclosed, for example, in Coe U.S. Pat. No. 4,303,418 and Van Hoesen U.S. Pat. No. 4,375,364.

Van Hoesen in particular is directed to replacement of the original wire discharge electrodes with rigid discharge electrodes. The Van Hoesen approach to solving the problem is to mount the rigid discharge electrode in the same manner as is conventional with the later rigid discharge electrode installations: the upper end is mounted to the upper high voltage frame at a single mounting point centered above the discharge region and the lower end is mounted to the lower high voltage frame at a single point centered below the discharge region. Since the existing or original upper and lower high voltage frames do not have mounting means centered with respect to the discharge region, this requires replacement or modification of both the upper and lower high voltage frames, together with removal of and discarding of the existing tensioning weights and their associated restraining means, as well as the use of tools for installation or removal of the replacement rigid discharge electrodes.

According to the present invention, these and other disadvantages of the prior art practices are avoided by adapting the replacement rigid discharge electrode to use the existing mounting means and the existing weights for supporting and tensioning the replacement rigid discharge electrode, avoiding replacement or modification of the upper and lower high voltage frames and eliminating the necessity of using tools for installation or removal of the rigid discharge electrode. This permits significant savings in the cost of the overhaul, and in addition, reduces the time when the plant must be shut down for overhaul.

According to a first principal aspect of the invention, there is provided a replacement for wire discharge electrodes in an electrostatic precipitator of the above character, the replacement comprising a single rigid discharge electrode for replacing the pair of wire discharge electrodes, the rigid discharge electrode comprising a central vertical support having a vertical height between an upper end and a lower end thereof, and having corona-generating regions along the vertical height; and a pair of shroud means on the upper end of the rigid discharge electrode, a pair of shroud means being spaced apart a distance equal to the given length, each shroud means comprising a lower end mounted on the upper end of the rigid discharge electrode and having an upper end cooperating with a corresponding one of the pair of mounting means. The upper end of the shroud comprises guide means for resting on the supporting and alignment surface after the guide means has been positioned above the supporting and alignment surface and lowered into engagement with the supporting and alignment surface, the guide means and the support means being shaped and formed to cooperate in preventing the guide means and the rigid discharge electrode from moving significantly in a horizontal direction until the guide means is lifted out of engagement with the supporting and alignment surface, whereby the rigid discharge electrode may be installed on or removed from the supporting and alignment surface without use of tools.

According to a second principal aspect of the invention, there is provided a replacement for wire electrodes in an electrostatic precipitator of the above character, the replacement comprising a single rigid discharge electrode for replacing the pair of wire discharge electrodes, the rigid discharge electrode comprising a central vertical support having a vertical height between an upper end and a lower end thereof, and having corona-generating regions along the vertical height; means suspending the rigid discharge electrode from the upper high voltage frame; and a pair of suspending means on the lower end of the rigid discharge electrode, the pair of suspending means being spaced apart a distance equal to the given length and suspending the original weights in the original weight positions.

According to another aspect of the invention applicable to either of the principal aspects, the corona-generating regions extend laterally from and on opposite sides of the vertical support, the regions lying in a plane generally parallel to the planes of the grounded electrodes.

According to another aspect of the invention applicable to either of the principal aspects, the regions are spaced apart a distance substantially the same as the given distance.

According to another aspect of the invention applicable to the first principal aspect, the replacement comprises a pair of suspending means on the lower end of the rigid discharge electrode, the pair of suspending means being spaced apart a distance equal to the given length and suspending the original weights in the original weight positions.

According to another aspect of the invention applicable to the first principal aspect of the invention, each mounting means comprises means defining an aperture in the upper high voltage frame, each shroud comprising an upper end fitting in and mating with a corresponding one of the apertures.

Other aspects will in part appear hereinafter and will in part be apparent from the following detailed description taken together with the accompanying drawings, wherein.

Figure 1:
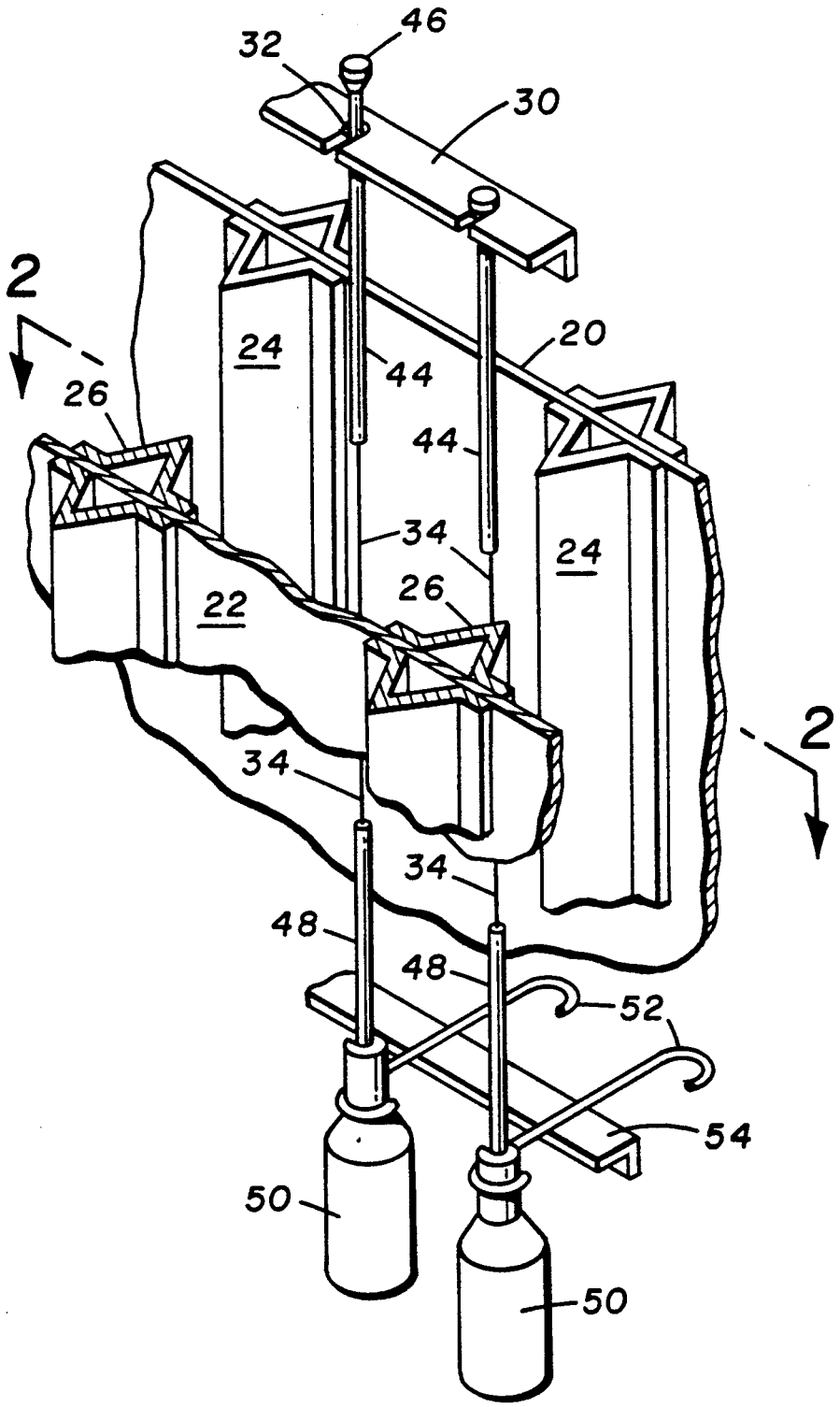
PRIOR ART FIG. 1.
FIG. 1 is an isometric view, partly broken away, of one example of the prior art precipitator with wire discharge electrodes.
Figure 2:
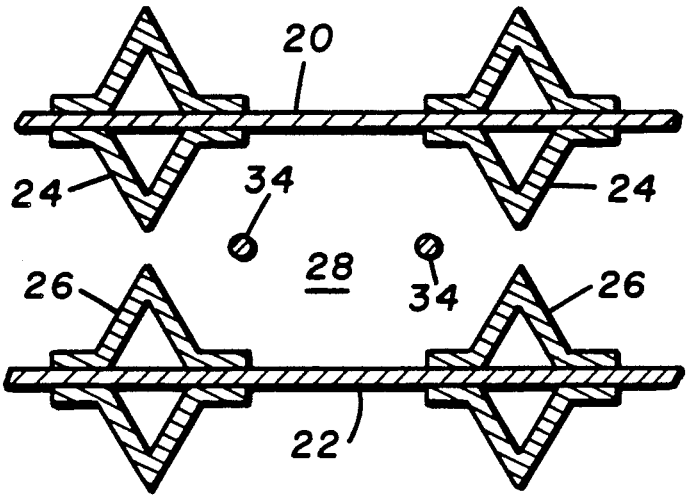
FIG. 2. PRIOR ART
FIG. 2 is a horizontal sectional view taken along line 2—2 in FIG. 1.

FIG. 1 illustrates a typical electrostatic precipitator using wire discharge electrodes which are to be replaced according to the present invention. The precipitator includes first and second parallel vertical substantially planar grounded electrodes 20 and 22. Since grounded electrodes 20 and 22 are typically formed from relatively thin sheet metal, vertical conductive stiffeners are provided. Accordingly, grounded electrode 20 has a plurality of stiffeners 24 evenly spaced along the width thereof, while grounded electrode 22 has a like plurality of stiffeners 26 evenly spaced along the width thereof. Each stiffener 24 on grounded electrode 20 is opposed by a corresponding stiffener 26 on grounded electrode 22, as best illustrated in FIG. 2. An adjacent pair of stiffeners 24 together with the corresponding opposed adjacent pair of stiffeners 26 define a discharge space 28 partially separated from adjacent discharge spaces by stiffeners 24 and 26.

Figure 3:
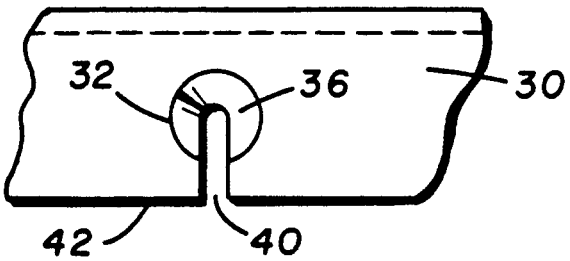
FIG. 3. PRIOR ART
FIG. 3 is a plan view of one of the upper mounting means in FIG. 1.
Figure 4:
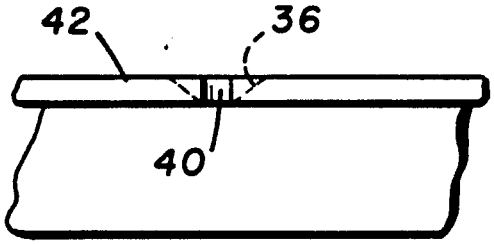
FIG. 4. PRIOR ART
FIG. 4 is an elevation view of the FIG. 3 mounting means.

The precipitator further comprises an upper high voltage frame 30 located above the plurality of discharge spaces 28. Frame 30 extends parallel to the planes of grounded electrodes 20 and 22. Frame 30 has a pair of spaced mounting means 32 above each discharge space 28 for supporting and aligning a corresponding pair of wire discharge electrodes 34. Each mounting means 32 comprises an upwardly facing supporting and aligning surface 36, an illustrative example of which is shown in FIGS. 3 and 4. As shown therein, surface 36 has an inverted frustoconical form extending vertically through frame 30, with slot 40 extending from edge 42 of frame 30 and communicating with surface 36. A line connecting the centers of mounting means 32 is generally parallel to and equally spaced from the planes of grounded electrodes 20 and 22, and has a given length. Numerous other specific types of supporting and aligning surfaces are present in existing wire discharge electrode installations.

Each wire discharge electrode 34 has shroud means 44 mounted on an upper end thereof cooperating with the corresponding supporting and alignment surface whereby each wire electrode is located in an original position In the illustrated embodiment, the lower ends of shroud means 44 are crimped onto the upper ends of wire discharge electrodes 34.

The upper end of each shroud means 44 comprises guide means 46 for resting on the corresponding supporting and alignment surface 36 after guide means 46 has been lowered into contact with the corresponding supporting and alignment surface. Guide means 46 and supporting and alignment surfaces are shaped and formed to cooperate in preventing each guide means 46 and its associated wire discharge electrode from moving significantly in a horizontal direction until the guide means 46 is lifted out of engagement with its associated supporting and alignment surface 36. This permits installation or removal of the wire discharge electrode 34 together with its associated shroud means 46 without the use of tools. During such installation or removal, an intermediate portion of shroud means 44 below guide means 46 passes through slot 40. In the embodiment illustrated, guide means 46 is in the form of an inverted frustoconical surface mating with surface 36.

The lower end of each wire discharge electrode comprises suspending means 48 for suspending an original weight 50 individual to the wire discharge electrode in an original weight position. Suspending means 48 typically was a shroud crimped onto the lower end of the wire discharge electrode, the lower end of shroud 48 cooperating with a slot communicating with an aperture in the upper end of weight 50, similar to the cooperation of guide means 46 and surfaces 36.

The prior art precipitator further comprises restraining means 52 for restricting movement of weight 50 in the horizontal direction from the original weight position, restraining means 52 being typically in the form of hooks 52 mounted on lower high voltage frame 54, each hook 52 partially encircling its corresponding weight 50.

Note that FIG. 1 shows the leftmost wire discharge electrode 34 and its associated shroud 44, suspending mean 48, and weight 50 slightly raised above the normal operating position. These elements need merely be lowered until guide means 46 engages supporting and alignment surface 36, whereupon installation is completed quickly and simply without the use of tools.

Figure 5:
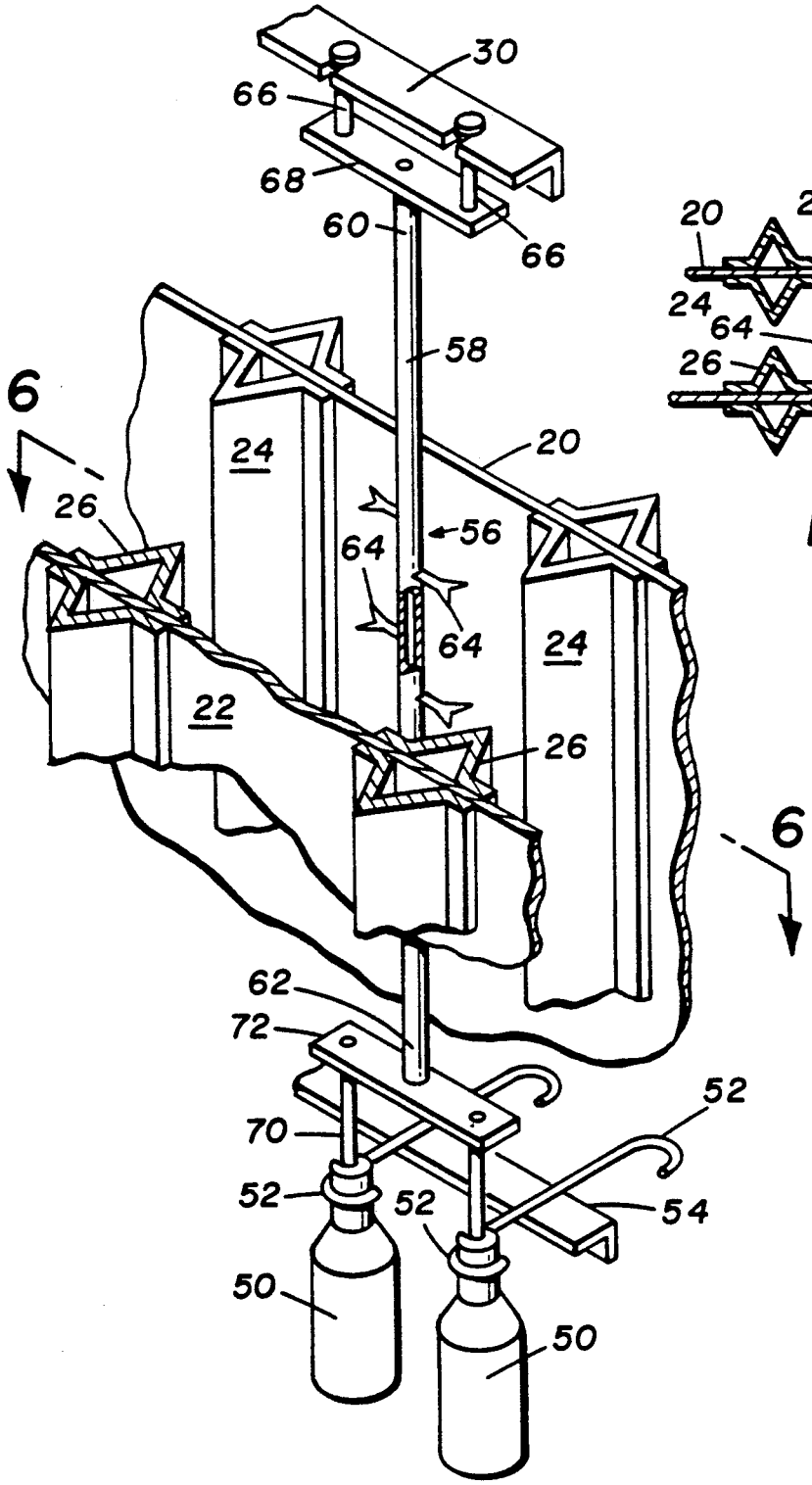
FIG. 5 is an isometric view, partly broken away, of a preferred embodiment of the invention.
Figure 6:
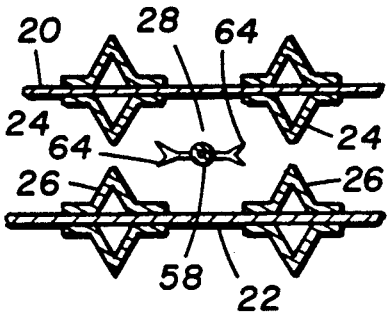
FIG. 6 is a horizontal sectional view taken along line 6—6 in FIG. 5.

According to the present invention and as illustrated in FIGS. 5 and 6, there is provided a replacement for the pairs of wire discharge electrodes. The replacement comprises a single rigid discharge electrode 56 for each pair of wire discharge electrodes. The rigid discharge electrode has a central vertical support 58 having a vertical height between an upper end 60 and a lower end 62. Rigid discharge electrode 56 has a plurality of corona-generating regions 64 along the vertical height.

A pair of shroud means 66 on upper end 62 are spaced apart a distance equal to the given length between mounting means 32. Each shroud means 66 has a lower end mounted on upper end 60 by means of transverse bar 68. The upper end of each shroud means 66 cooperates with a corresponding one of mounting means 32, and comprises guide means for resting on supporting and alignment surface 36 after the guide means has been positioned above surface 36 and lowered into contact with surface 36. The guide means on shroud means 66 are shaped and formed to cooperate with support means 32 in preventing guide means and associated rigid discharge electrode 56 from moving significantly in a horizontal direction until the guide means on shrouds 66 is lifted out of engagement with surface 36. Preferably, the guide means on each shroud 66 is formed identically to the guide means 46 (FIG. 1) on shrouds 44 being replaced, but this is not essential provided that the function of supporting and aligning is achieved.

As illustrated, corona-generating regions 64 preferably extend laterally from and on opposite sides of vertical support 58, and lie in a plane parallel to the planes of grounded electrodes 20 and 22, and may be spaced apart a distance substantially the same as the given distance between shrouds 66.

The preferred replacement further comprises a pair of suspending means 70 mounted on the lower end thereof, as by transverse bar 72. Suspending means 70 are spaced apart a distance substantially the same as the given distance, and suspend original weights 50 in their original positions, where weights 50 are restrained by original restraining means 52.

As used herein, the term shroud means not only a member crimped onto a wire, but also any means for suspending an electrode from the existing supporting and alignment surface. Shrouds commonly used with wire electrodes include the illustrated frusto-conical surface, but also partial spherical surfaces, stepped-diameter cylindrical surfaces, variously shaped hooks for use when there is no slot 40 provided, and a simple loop formed in the upper end of the wire discharge electrode, the latter fitting over a horizontal peg protruding from the upper high voltage electrode and being retained in position by a cotter pin or the like.

In any event, the guide means on shrouds 66 are selected and adapted to cooperate with the existing supporting and alignment surfaces in centering rigid discharge electrode 56 between grounded electrodes 20 and 22.

Accordingly, the invention provides for replacing the original wire discharge electrodes with a rigid discharge electrode without the use of tools, providing substantial savings by avoiding modifying or replacing either the existing upper high voltage frame 30 or the existing lower high voltage frame 54 and restraining means 52. This further permits reducing the time when the plant must be shut down for overhaul, the latter also providing substantial savings.

I claim:

1. In an electrostatic precipitator having wire discharge electrodes and having first and second parallel vertical substantially planar grounded electrodes, each of said grounded electrodes having a plurality of vertical conductive stiffeners evenly spaced along the width thereof, corresponding stiffeners on said first and second grounded electrodes being opposed whereby an adjacent pair of stiffeners on said first grounded electrode together with a corresponding adjacent pair of stiffeners on said second grounded electrode define a discharge space partially separated from adjacent discharge spaces by said stiffeners, said precipitator further comprising a high voltage frame located above said plurality of discharge spaces and extending parallel to the planes of said grounded electrodes, said frame having a pair of spaced mounting means above each said discharge space for supporting a corresponding pair of wire discharge electrodes, a line connecting each said pair of mounting means being parallel to and equally spaced from the planes of said first and second grounded electrodes, said line having a given length, each said wire discharge electrode having shroud means on an upper end thereof mating with said corresponding mounting means and having a lower end, each said lower end of said wire discharge electrodes comprising suspending means suspending a weight individual to said wire discharge electrode in an original position, and means for restricting movement of said weights in the horizontal plane from said original positions, the improvement comprising:

a. a single rigid discharge electrode for replacing said pair of wire discharge electrodes, said rigid discharge electrode comprising a rigid vertical support having a vertical length between an upper end and a lower end thereof, and having a plurality of corona-generating members spaced along said vertical length, said corona-generating members extending laterally from and on opposite sides of said vertical support and generally parallel to the planes of said grounded electrodes to discharge regions spaced apart on opposite sides of said vertical support substantially the same distance as said given length;

b. a pair of shroud means on said upper end of said rigid discharge electrode, said pair of shroud means being spaced apart a distance equal to said given length and mating with said pair of mounting means; and c. a pair of suspending means on said lower end of said rigid discharge electrode, said pair of suspending means being spaced apart a distance equal to said given length and suspending said weights in said original positions.

2. The electrostatic precipitator defined in claim 1, wherein said corona-generating regions extend laterally from and on opposite sides of said vertical support, said regions lying in a plane generally parallel to said planes of said grounded electrodes.

3. The electrostatic precipatator defined in claim 1, wherein said regions are spaced apart a distance substantially the same as said given distance.

4. The electrostatic precipitator defined in claim 1, further comprising a pair of suspending means mounted on said lower end of said rigid discharge electrode, said pair of suspending means being spaced apart a distance substantially equal to said given length and suspending said original weights in said original positions.

5. The electrostatic precipitator defined in claim 1, wherein each mounting means comprises means defining an aperture in said upper high voltage frame, each said shroud means comprising an upper end fitting in and mating with a corresponding one of said apertures.

6. In an electrostatic precipitator having wire discharge electrodes and having first and second parallel vertical substantially planar grounded electrodes, each of said grounded electrodes having a plurality of vertical conductive stiffeners evenly spaced along the width thereof, corresponding stiffeners on said first and second grounded electrodes being opposed whereby an adjacent pair of stiffeners on said first grounded electrode together with a corresponding adjacent pair of stiffeners on said second grounded electrode define a discharge space partially separated from adjacent discharge spaces by said stiffeners, said precipitator further comprising an upper high voltage frame located above said plurality of discharge spaces and extending parallel to said planes of said grounded electrodes, said upper high voltage frame having a pair of spaced mounting means above each said discharge space for supporting a corresponding pair of wire discharge electrodes, a line connecting each said pair of mounting means being parallel to and equally spaced from the planes of said first and second grounded electrodes, said line having a given length, each said wire discharge electrode having shroud means on an upper end thereof mating with said corresponding mounting means and having a lower end, each said lower end of said wire discharge electrodes comprising suspending means suspending an original weight individual to said wire discharge electrode in an original weight position, and restraining means for restricting movement of said original weights in the horizontal plane from said original weight positions, the improvement comprising:

a. a single rigid discharge electrode for replacing said pair of wire discharge electrodes, said rigid discharge electrode comprising a rigid vertical support having a vertical height between an upper and a lower end thereof, and having corona-generating regions along said vertical height;

b. means suspending said rigid discharge electrode from said upper high voltage frame; and c. a pair of suspending means mounted on said lower end of said rigid discharge electrode, said pair of suspending means being spaced apart a distance substantially equal to said given length and suspending said original weights in said original weight positions.

7. The electrostatic precipitator defined in claim 6, wherein said corona-generating regions extend laterally from and on opposite sides of said vertical support, said regions lying in a plane generally parallel to said planes of said grounded electrodes.

8. The electrostatic precipitator defined in claim 6, wherein said regions are spaced apart a distance substantially the same as said given distance.

9. A method of replacing wire discharge electrodes in an electrostatic precipitator having first and second parallel vertical substantially planar grounded electrodes, each of said grounded electrodes having a plurality of vertical conductive stiffeners evenly spaced along the width thereof, corresponding stiffeners on said first and second grounded electrodes being opposed whereby an adjacent pair of stiffeners on said first grounded electrode together with a corresponding adjacent pair of stiffeners on said second grounded electrode define a discharge space partially separated from adjacent discharge spaces by said stiffeners, said precipitator further comprising a high voltage frame located above said plurality of discharge spaces and extending parallel to the planes of said grounded electrodes, said frame having a pair of spaced mounting means above each said discharge space for supporting a corresponding pair of wire discharge electrodes, a line connecting each said pair of mounting means being parallel to and equally spaced from the planes of said first and second grounded electrodes, said line having a given length, each said wire discharge electrode having shroud means on an upper end thereof mating with said corresponding mounting means and having a lower end, each said lower end of said wire discharge electrodes comprising suspending means suspending a weight individual to said wire discharge electrode in an original position, and means for restricting movement of said weights in the horizontal plane from said original positions, said method comprising:

(a) removing said pair of wire discharge electrodes;

(b) replacing said pair of wire discharge electrodes with a single rigid discharge electrode, said rigid discharge electrode comprising a rigid vertical support having a vertical length between an upper end and a lower end thereof, and having a plurality of corona-generating members spaced along said vertical length, said corona-generating members extending laterally from and on opposite sides of said vertical support and generally parallel to the planes of said grounded electrodes to discharge regions spaced apart on opposite sides of said vertical support substantially the same distance as said given length;

(c) said rigid discharge electrode comprising a pair of shroud means on said upper end of said rigid discharge electrode, said pair of shroud means being spaced apart a distance equal to said given length and mating with said pair of mounting means; and (d) said rigid discharge electrode comprising a pair of suspending means on said lower end of said rigid discharge electrode, said pair of suspending means being spaced apart a distance equal to said given length and suspending said weights in said original positions.

* * * * *